US008517524B1

(12) United States Patent
Turgeman

(10) Patent No.: US 8,517,524 B1
(45) **Date of Patent: *Aug. 27, 2013**

(54) INK JET PRINTER CARTRIDGE REFILLING METHOD AND APPARATUS

(76) Inventor: Shahar Turgeman, Boca Raton, FL (US)

( * ) Notice: Subject to any disclaimer, the term of this patent is extended or adjusted under 35 U.S.C. 154(b) by 16 days.

This patent is subject to a terminal disclaimer.

(21) Appl. No.: 13/352,290

(22) Filed: Jan. 17, 2012

Related U.S. Application Data

(63) Continuation-in-part of application No. 12/575,438, filed on Oct. 7, 2009, now Pat. No. 8,157,362, and a continuation-in-part of application No. 12/363,572, filed on Jan. 30, 2009, now Pat. No. 8,096,630, which is a continuation-in-part of application No. 11/342,442, filed on Jan. 30, 2006, now abandoned.

(51) Int. Cl.
*B41J 2/175* (2006.01)

(52) U.S. Cl.
USPC ..... 347/85

(58) Field of Classification Search
USPC ..... 347/7, 19, 84, 85, 86, 87
See application file for complete search history.

(56) References Cited

U.S. PATENT DOCUMENTS

| | | | | |
|---|---|---|---|---|
| 4,907,013 | A | 3/1990 | Hubbard et al. | |
| 5,164,747 | A | 11/1992 | Osada et al. | |
| 5,663,754 | A | 9/1997 | Lorenze, Jr. et al. | |
| 5,835,108 | A | 11/1998 | Beauchamp et al. | |
| 5,875,615 | A * | 3/1999 | Ito et al. | 53/474 |
| 5,927,547 | A | 7/1999 | Papen et al. | |
| 6,056,386 | A | 5/2000 | Nohata et al. | |
| 6,058,984 | A | 5/2000 | Sato | |
| 6,106,094 | A | 8/2000 | Otani et al. | |
| 6,158,837 | A | 12/2000 | Hilton et al. | |
| 6,164,766 | A | 12/2000 | Erickson | |
| 6,215,557 | B1 | 4/2001 | Owens | |
| 6,261,353 | B1 | 7/2001 | Doi et al. | |
| 6,273,151 | B1 | 8/2001 | Kong | |
| 6,289,654 | B1 | 9/2001 | Yamaguchi et al. | |
| 6,302,534 | B1 * | 10/2001 | Tsukahara et al. | 347/86 |
| 6,315,383 | B1 | 11/2001 | Sarmast et al. | |
| 6,331,038 | B1 | 12/2001 | Boleda et al. | |
| 6,352,331 | B1 | 3/2002 | Armijo et al. | |
| 6,361,138 | B1 | 3/2002 | Seino et al. | |
| 6,539,985 | B2 | 4/2003 | Shinada et al. | |
| 6,568,786 | B2 | 5/2003 | Sarmast et al. | |
| 6,585,007 | B2 | 7/2003 | Kubokawa | |
| 6,612,683 | B2 | 9/2003 | Takahashi et al. | |
| 6,616,260 | B2 | 9/2003 | Skene et al. | |
| 6,623,096 | B1 | 9/2003 | Castano et al. | |

(Continued)

*Primary Examiner* — Anh T. N. Vo
(74) *Attorney, Agent, or Firm* — Allen D. Hertz, P.A.; Allen D. Hertz

(57) ABSTRACT

The present invention provides an automated system for refilling printer ink cartridges. The system includes a computer with memory provided to store information relating to a plurality of ink cartridges, and a user interface that is connected to the computer and can receive a model number of a particular ink cartridge to be refilled. Moreover, the system employs a vacuum chamber with one or more needles provided to add ink into the ink cartridge. The vacuum chamber is connected to a vacuum pump that draws suction on the vacuum chamber to reduce pressure in the vacuum chamber. In operation, the computer controls the vacuum pump to reduce the pressure in the vacuum chamber to a specific pressure based on the model number of the ink cartridge, and once this pressure is reached, ink is added to the ink cartridge by the needle accordingly.

20 Claims, 13 Drawing Sheets

(56) References Cited

U.S. PATENT DOCUMENTS

| | | | | |
|---|---|---|---|---|
| 6,637,853 | B1 | 10/2003 | Ahne et al. | |
| 6,644,772 | B2 | 11/2003 | Choi | |
| 6,679,577 | B2 | 1/2004 | Du et al. | |
| 6,705,694 | B1 | 3/2004 | Barbour et al. | |
| 6,729,360 | B2 | 5/2004 | Sesek et al. | |
| 6,764,155 | B2 | 7/2004 | D'Souza et al. | |
| 6,783,215 | B2 | 8/2004 | Yoshida et al. | |
| 6,973,943 | B2 | 12/2005 | Sesek et al. | |
| 7,089,973 | B2 | 8/2006 | Nicodem et al. | |
| 7,172,272 | B2 | 2/2007 | Tsuchiya et al. | |
| 7,344,215 | B2 | 3/2008 | Cutler et al. | |
| 7,540,597 | B2 | 6/2009 | Guhse et al. | |
| 8,157,362 | B1 * | 4/2012 | Turgeman | 347/85 |
| 2001/0019343 | A1 | 9/2001 | Walker et al. | |
| 2002/0149641 | A1 | 10/2002 | Du et al. | |
| 2002/0175965 | A1 | 11/2002 | Skene et al. | |
| 2003/0081062 | A1 | 5/2003 | Kim et al. | |
| 2003/0146951 | A1 | 8/2003 | Skene et al. | |
| 2004/0046811 | A1 | 3/2004 | D'Souza et al. | |
| 2004/0263588 | A1 | 12/2004 | Ansier et al. | |
| 2004/0263589 | A1 | 12/2004 | Ansier et al. | |
| 2005/0018006 | A1 | 1/2005 | Im et al. | |
| 2005/0034777 | A1 | 2/2005 | Nicodem et al. | |
| 2005/0088495 | A1 | 4/2005 | Chan | |
| 2005/0099447 | A1 | 5/2005 | Hsu et al. | |
| 2005/0219333 | A1 | 10/2005 | Yuen | |
| 2006/0109320 | A1 | 5/2006 | Cutler et al. | |
| 2007/0051421 | A1 | 3/2007 | Sarnoff et al. | |
| 2007/0052740 | A1 | 3/2007 | Guhse et al. | |
| 2007/0052748 | A1 | 3/2007 | Sarnoff et al. | |
| 2007/0052770 | A1 | 3/2007 | Guhse et al. | |
| 2007/0052776 | A1 | 3/2007 | Guhse et al. | |
| 2007/0052777 | A1 | 3/2007 | Guhse et al. | |

* cited by examiner

300

| 325 Printer Type | 330 Cartridge Model No. | 335 Required Ink Amount | 340 Run Time | 345 Pause Time |
|---|---|---|---|---|
| 1200 | 51640/C/M/Y | 42 | 1 | 1 |
| 5550 | C6657 | 17 | 1 | 2 |
| 2000C | C4841/C/M/Y | 28 | 2 | 3 |
| 1120 | C1823D | 30 | 1.5 | 1 |

305 310 315 320

*FIG. 3*

INK JET PRINTER CARTRIDGE REFILLING METHOD AND APPARATUS

CROSS REFERENCE TO RELATED APPLICATIONS

This application is a Continuation-In-Part Patent Application of co-pending U.S. patent application Ser. No. 12/575,438 filed on Oct. 7, 2009 and U.S. patent application Ser. No. 12/363,572, filed Jan. 30, 2009 (issuing as U.S. Pat. No. 8,096,630), which is a Continuation-In-Part of U.S. patent application Ser. No. 11/342,442, filed Jan. 30, 2006 (now abandoned), the contents of which are incorporated herein by reference into the present application.

FIELD OF THE INVENTION

The present invention relates to the field of refilling spent ink cartridges. In particular, the present invention relates to an automated system and method for refilling ink cartridges for ink jet printers.

BACKGROUND OF THE INVENTION

Ink jet printers are a popular form of printer used with computers and similar applications involving document printing or graphics preparation. Typical ink jet printers, such as those manufactured by Original Equipment Manufacturers (OEMs) such as Hewlett Packard, have replaceable ink jet cartridges with built-in print heads. While such OEM ink jet cartridges are a convenient manner of supplying ink to such printers, the cartridges are necessarily expensive due to their complexity and the provision of print heads with the cartridges.

Cartridges provided by printer manufacturers are typically not designed to be refilled when the ink supply runs out. It is well known, however, that such cartridges and their associated print heads have useful lives significantly longer than that provided by the initial supply of ink. Therefore, an after-market industry has evolved, that is directed to providing systems for refilling cartridges with ink. The need to provide ink refilling is especially acute in the case of color ink cartridges, because typically one color will run out of ink before the other colors are depleted.

Refilling ink cartridges with ink is not an easy task. First, some means must be provided to supply the ink to the interior of the cartridges. Because the ink reservoirs are typically filled with foam sponge, the ink refilling process is slow due to slow absorption of ink by the foam. Users typically do not have the patience to refill slowly (typically by squeezing a refill reservoir or by gravity feed), and this causes ink to flow into the foam sponge at a rate that is usually too fast to be absorbed. Ink accumulates in the bottom of the cartridge and overflows from the top and from the print head.

To help speed the process, some refilling mechanisms of the prior art pressurize the ink while refilling the cartridge. See, e.g., U.S. Pat. No. 6,945,640 to Cheok, incorporated by reference herein. Such pressurization merely exacerbates an air injection problem, by inducting air along with the ink refilling the cartridge, and by preventing the removal of air from the foam sponge. The air injected into the foam sponge reservoir during refilling causes vapor lock in the ink reservoir. Ink then cannot reach the print head, and the printer fails. In order to overcome this problem, Cheok teaches that the air must subsequently be removed through vacuum evacuation of the cartridge. However, Cheok does not teach how much ink to add to the cartridge.

Prior art refilling mechanisms may not inject the proper quantity of ink into the reservoir. Such overfilling may bind the internal cartridge ink pump, create a mess from weeping ink, and may prevent the cartridge from functioning properly.

In order to avoid vapor lock, U.S. Pat. No. 4,967,207 to Ruder teaches completely evacuating the cartridge, and then supplying ink to refill the cartridge. In essence, Ruder improperly teaches that the vacuum within the cartridge will suck the proper amount of ink back into it. However, it is impossible to achieve a perfect vacuum. If the cartridge could structurally withstand a near perfect vacuum without being damaged, in Ruder's process, the cartridge would be completely filled with ink, and thus would be overfilled. A less than perfect vacuum will not fill the cartridge completely. A properly filled cartridge has a precise quantity of ink, and a certain amount of airspace. Therefore, Ruder does not solve the ink quantity problem.

U.S. Pat. No. 4,968,998 to Allen discloses refilling the cartridge while evacuating, such that the evacuation rate exceeds the filling rate. This Patent states that the cartridge can never be overfilled; however, if the air were completely removed from the cartridge, which would eventually happen by Allen's method, the airspace in the cartridge would no longer exist.

U.S. Pat. No. 5,903,292 to Scheffelin, et al. teaches refilling a spring-loaded collapsible ink bag, which maintains a negative pressure to draw ink into the bag until it is substantially full. However, many commercially available print cartridges are not constructed with such spring loaded bags.

Another prior art solution to these refilling problems is a "Clip-In" type refill system. The original ink cartridge is modified by removing all of the original ink reservoirs, such that only the print heads and the case are left. Removable ink reservoirs are supplied, so the user only has to change the ink reservoir assembly causing no mess. The disadvantage of this system is that it the user must be supplied with a pre-modified cartridge specially-adapted for use only with the removable ink reservoirs, and in practice, this system is nearly as costly as OEM printer cartridges.

Thus, there presently exists a need for a simple method and apparatus for refilling printer ink cartridges that eliminates the problems of slow refilling, overfilling and potential vapor lock.

BRIEF SUMMARY OF THE INVENTION

The present invention provides an automated system for refilling printer ink cartridges. The system includes a computer with memory provided to store information relating to a plurality of ink cartridges, and a user interface that is connected to the computer and can receive a model number of a particular ink cartridge to be refilled. Moreover, the system employs a vacuum chamber with one or more needles provided to add ink into the ink: cartridge. The vacuum chamber is connected to a vacuum pump that draws suction on the vacuum chamber to reduce pressure in the vacuum chamber. In operation, the computer controls the vacuum pump to reduce the pressure in the vacuum chamber to a specific pressure based on the model number of the ink cartridge, and once this pressure is reached, ink is added to the ink cartridge by the needle accordingly.

In one aspect, the present invention is directed to an automated system for refilling an ink cartridge, comprising: a computer having memory configured to store information relating to a plurality of ink cartridges, the information including a specific pressure designated to refill the ink cartridge; a user interface coupled to the computer and configured to receive a model number of the ink cartridge; a vacuum chamber having at least one ink insertion device configured to add ink to the ink cartridge; and a vacuum pump controlled by the computer to reduce the pressure in the vacuum chamber to the specific pressure, and wherein ink is added to the ink cartridge by the at least one ink insertion device when the specific pressure is reached.

In another aspect of the present invention, the automated system further comprises a digital pressure gauge coupled to the computer, wherein the computer further controls the vacuum pump to reduce the pressure in the vacuum chamber in response to a measurement of the digital pressure gauge.

In another aspect of the present invention, the computer further controls the vacuum pump to maintain the pressure in the vacuum chamber as ink is added to the ink cartridge.

In another aspect of the present invention, the vacuum chamber comprises a docking station configured to receive a cartridge cradle, wherein the cartridge cradle is configured to securely hold the ink cartridge.

In another aspect of the present invention, the cartridge cradle is selected based on the model number of the ink cartridge.

In another aspect of the present invention, the cartridge cradle comprises a lid having at least one aperture configured to guide the ink insertion device into the ink cartridge.

In another aspect of the present invention, the ink insertion device is a needle having at least one aperture configured to distribute ink into a foam sponge of the ink cartridge and the lid guides the needle into the foam at an appropriate depth.

In another aspect of the present invention, the cartridge cradle comprises an emptying aperture aligned next to a print head of the ink cartridge.

In another aspect of the present invention, the automated system further comprises an ink cartridge emptying system coupled to the emptying aperture of the cartridge cradle, and configured to remove ink from the ink cartridge.

In another aspect of the present invention, the ink cartridge emptying system comprises: a vacuum pump electronically controlled by the computer; and a filter coupled between the vacuum pump and the aperture of the cartridge cradle, wherein the vacuum pump draws a suction from the filter, thereby removing ink from the ink cartridge.

In another aspect of the present invention, the automated system further comprises a cleaning station configured to ultrasonically clean a print head of the ink cartridge at 28 kilohertz or less.

In another aspect of the present invention, the print head of the ink cartridge is ultrasonically cleaned at a temperature between 60° and 80° Celsius.

In another aspect of the present invention, the amount of ink added to the ink cartridge is based on the model number of the ink cartridge.

In another aspect, the present invention is directed to a method for refilling a printer ink cartridge, the method comprising: storing information relating to a plurality of ink cartridges, the information including a specific pressure designated to refill the ink cartridge; receiving a model number, via a user interface, of the ink cartridge; placing the cartridge in a vacuum chamber; determining the specific pressure for the vacuum chamber based on the model number; reducing the pressure in the vacuum chamber to the specific pressure; and adding an amount of ink by an ink insertion device when the specific pressure in the vacuum chamber is reached.

In another aspect of the present invention, the adding step further comprises maintaining the pressure in the vacuum chamber.

In another aspect of the present invention, the method further comprises providing a docking station for receiving a cartridge cradle securely holding the ink cartridge.

In another aspect of the present invention, the method further comprises selecting the cartridge cradle based on the received model number.

In another aspect of the present invention, the method further comprises guiding the ink insertion device at an appropriate depth, via at least one aperture in a lid of the cartridge cradle, into a foam sponge of the ink cartridge.

In another aspect of the present invention, the method further comprises removing ink from the ink cartridge, by a filter and a vacuum pump, before the adding step.

In another aspect of the present invention, the method further comprises ultrasonically cleaning a print head of the ink cartridge at 28 kilohertz or less.

In another aspect of the present invention, the ultrasonic cleaning step further comprises heating a cleanser at a temperature between 60° and 80° Celsius.

In another aspect of the present invention, the adding step further comprises determining a required amount of ink to be added based on the received model number.

In another aspect of the present invention, the method further comprises repeating the adding step for a plurality of times based on the amount of ink added during a first time period and the required amount of ink.

In another aspect of the present invention, the method further comprises pausing for a time period between adding steps.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which:

FIG. 3 presents an exemplary chart that illustrates a database schema;

Like reference numerals refer to like parts throughout the several views of the drawings.

DETAILED DESCRIPTION OF THE INVENTION

Figure 1:
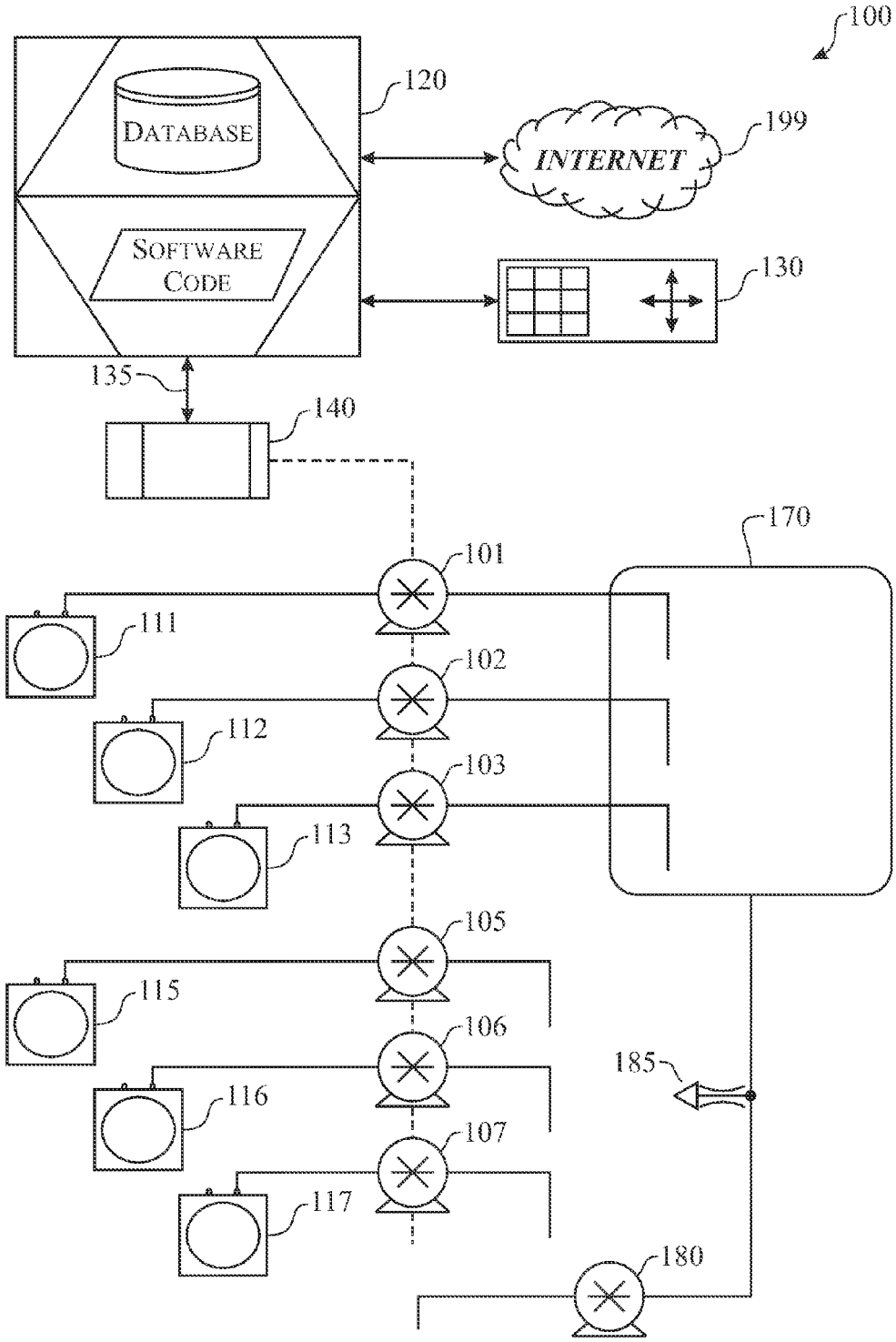
FIG. 1 presents an exemplary block diagram illustrating a system for refilling a printer cartridge.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. In other implementations, well-known features and methods have not been described in detail so as not to obscure the invention. For purposes of description herein, the terms "upper", "lower", "left", "right", "front", "back", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments that may be disclosed herein are not to be considered as limiting, unless the claims expressly state otherwise.

The present invention comprises a system for refilling a printer ink cartridge. In a preferred embodiment, the method and system refill the cartridge while the cartridge is under a vacuum to prevent vapor lock. The system preferably comprises a positive displacement, peristaltic ink filling pump that operates under computer control to ensure that the proper amount of ink is added to the cartridge without overfilling the cartridge. The method preferably incorporates filling the cartridge while under vacuum, with pauses between filling events to ensure that air can migrate out of the cartridge. As described below, the filling and pause cycle times are dependent upon the type of cartridge being filled.

The present invention may be described herein in terms of functional block components, code listings, optional selections and various processing steps. It should be appreciated that such functional blocks may be realized by any number of hardware and/or software components configured to perform the specified functions. For example, the present invention may employ various integrated circuit components, e.g., memory elements, processing elements, logic elements, look-up tables, and the like, which may carry out a variety of functions under the control of one or more microprocessors or other control devices.

Similarly, the software (program code) elements of the present invention may be implemented with any programming or scripting language such as C, C++, C#, Java, COBOL, assembler, PERL, or the like, with the various algorithms being implemented with any combination of data structures, objects, processes, routines or other programming elements. The system preferably incorporates software modules preferably programmed in Visual C and Visual Basic. Any computer having an operating system using Microsoft Windows 95 or newer can execute the object code created.

Further, it should be noted that the present invention may employ any number of conventional techniques for data transmission, signaling, data processing, network control, and the like.

It should be appreciated that the particular implementations shown and described herein are illustrative of the invention and its best mode and are not intended to otherwise limit the scope of the present invention in any way. Indeed, for the sake of brevity, conventional data networking, and application development and other functional aspects of the systems (and components of the individual operating components of the systems) may not be described in detail herein. Furthermore, the connecting lines shown in the various figures contained herein are intended to represent exemplary functional relationships and/or physical or virtual couplings between the various elements. It should be noted that many alternative or additional functional relationships or physical or virtual connections might be present in a practical electronic data communications system.

As will be appreciated by one of ordinary skill in the art, the present invention may be embodied as a method, a data processing system, a device for data processing, and/or a computer program product. Accordingly, the present invention may take the form of an entirely software embodiment, an entirely hardware embodiment, or an embodiment combining aspects of both software and hardware. Furthermore, the present invention may take the form of a computer program product on a computer-readable storage medium having computer-readable program code means embodied in the storage medium. Any suitable computer-readable storage medium may be utilised, including hard disks, CD-ROM, optical storage devices, magnetic storage devices, and/or the like.

The present invention is described below with reference to block diagrams and flowchart illustrations of methods, apparatus (e.g., systems), and computer program products according to various aspects of the invention. It will be understood that each functional block of the block diagrams and the flowchart illustrations, and combinations of functional blocks in the block diagrams and flowchart illustrations, respectively, can be implemented by computer program instructions. These computer program instructions may be loaded onto a general purpose computer, special purpose computer, or other programmable data processing apparatus to produce a machine, such that the instructions that execute on the computer or other programmable data processing apparatus create means for implementing the functions specified in the flowchart block or blocks.

These computer program instructions may also be stored in a computer-readable memory that can direct a computer or other programmable data processing apparatus to function in a particular manner, such that the instructions stored in the computer-readable memory produce an article of manufacture including instruction means that implement the function specified in the flowchart block or blocks. The computer program instructions may also be loaded onto a computer or other programmable data processing apparatus to cause a series of operational steps to be performed on the computer or other programmable apparatus to produce a computer-implemented process such that the instructions that execute on the computer or other programmable apparatus provide steps for implementing the functions specified in the flowchart block or blocks.

Accordingly, functional blocks of the block diagrams and flowchart illustrations support combinations of means for performing the specified functions, combinations of steps for performing the specified functions, and program instruction means for performing the specified functions. It will also be understood that each functional block of the block diagrams and flowchart illustrations, and combinations of functional blocks in the block diagrams and flowchart illustrations, can be implemented by either special purpose hardware based computer systems that perform the specified functions or steps, or suitable combinations of special purpose hardware and computer instructions.

One skilled in the art will also appreciate that, for security reasons, any databases, systems, or components of the present invention may consist of any combination of databases or components at a single location or at multiple locations, wherein each database or system includes any of various suitable security features, such as firewalls, access codes, encryption, de-encryption, compression, decompression, and/or the like.

The scope of the invention should be determined by the appended claims and their legal equivalents, rather than by the examples given herein. For example, the steps recited in any method claims may be executed in any order and are not limited to the order presented in the claims. Moreover, no element is essential to the practice of the invention unless specifically described herein as "critical" or "essential."

An exemplary block diagram illustrating a preferred embodiment for a computer ink cartridge refilling system 100 is presented in FIG. 1. The computer ink cartridge refilling system 100 includes a computer 120 and a touch screen 130. The computer 120 includes a microprocessor, a user interface (such as the touch screen 130), a digital memory storage device, software program code 150 which provides an instruction set to the microprocessor and a respective database 125. As shown, the computer 120 is interfaced with the Internet 199 via a respective communications interface such as a NIC card, WiFi interface, a modem, and the like. Communications between the computer 120 and the troubleshooting facilities may be physically facilitated through wired (cable, fiber-optic, T1 lines, and the like) or wireless links on which electronic signals can propagate, and may be embodied, for example, as (i) a dedicated wide area network (WAN), (ii) a telephone network, including the combination of local and long distance wire or wireless facilities and switches known as the public switched telephone network ("PSTN"), or (iii) the Internet 199.

The computer 120 is preferably interfaced through an RS-232 serial port to the relay board 140 via the communications cable 135. Under the control of the computer 120, the relay board 140 supplies power to various motors to control the operation of the attached pumps. These pumps are color ink pumps 101-103, comprising yellow 101, cyan 102, and magenta 103, a waste pump 105, a cleaning pump 106, and a black ink pump 107, as illustrated in FIG. 1. Each ink pump draws ink from an associated reservoir, yellow 111, cyan 112, magenta 113 and black 117 and supplies the ink via a needle inserted into the cartridge. Preferably, each pump is a positive displacement, peristaltic pump that can be run in the reverse direction, so that residual ink can be removed from the line and returned to the reservoir. The waste pump 105 draws liquid from the cartridge into a waste reservoir 115. The cleaning pump 106 supplies a cleaning solvent drawn from the associated reservoir 116 to the cartridge via a needle inserted into the cartridge.

The ink lines from the color ink pumps 101, 102, 103 run through the wall of a vacuum chamber 170. The associated needle may be inserted into the cartridge to be refilled. The vacuum chamber 170 has a door that can be opened to place the cartridge within the chamber. Preferably, the door seats on a sealing surface of the chamber.

Air from the vacuum chamber 170 is removed by the vacuum pump 180. As air is removed from the chamber, the door and sealing surface seals the vacuum chamber so that an appropriate vacuum can be drawn. The vacuumstat 185 controls the amount of vacuum that the pump 180 draws on the chamber 170.

Figure 2:
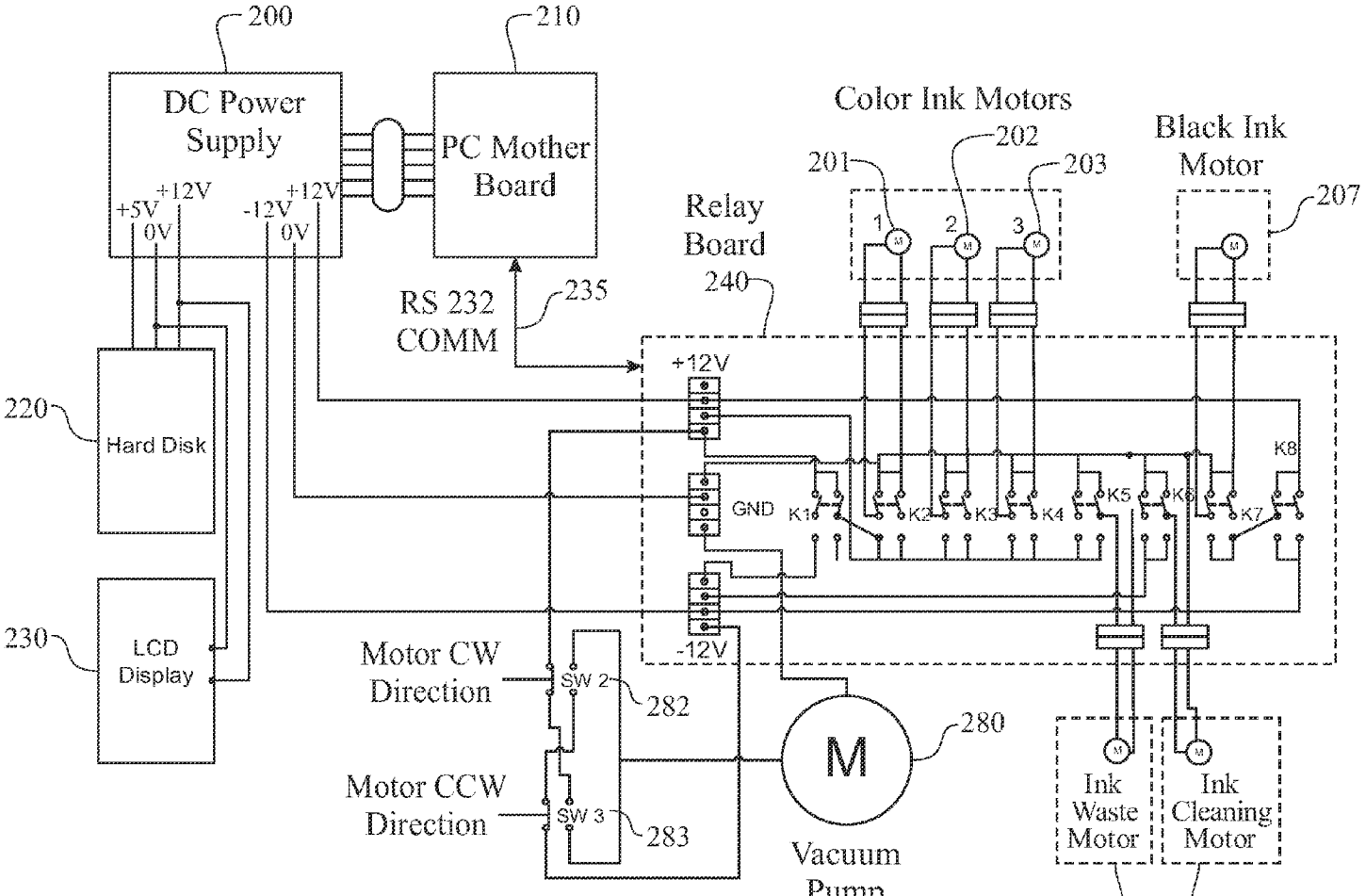
FIG. 2 presents an exemplary schematic wiring diagram for the printer cartridge ink refilling system.

An exemplary schematic wiring diagram for the printer cartridge ink refilling system is presented in FIG. 2. As illustrated, a direct current (DC) power supply 200 provides power to a personal computer (PC) motherboard 210, a hard disk 220, and a Liquid Crystal Display (LCD) 230. The DC power supply 200 also provides positive and negative 12 VDC power to a relay board 240. The relay board 240 is connected to the PC motherboard 210 via an RS-232 communications link 235. The relay board 240 provides 12 VDC of opposite polarities to the motors 201-203, 205-207 via the relays K1-K8 to run the motor in either direction. The switches 282, 283 provide power to the vacuum pump motor 280 to run this motor in either direction.

A chart illustrating an exemplary database schema 300 is presented in FIG. 3. The database 300 preferably stores information respective to different printers and their associated cartridges that are to be refilled. The database 300 maintains a plurality of records, such that each of the records 305-320 is associated with a type of printer and the print cartridge used in that printer. For each cartridge identified by a cartridge model number in field 330, the database 300 includes a required amount of ink to refill the cartridge in field 335. Preferably, this amount is determined by weighing an empty cartridge and a brand new cartridge. The difference in weight times the density of the ink equals the volumetric amount of ink that must be added to the cartridge in order to refill it.

In addition, the database 300 preferably includes fields for a length of time that the ink pump should be run and a length of time the ink pump should pause, during each filling cycle, in fields 340 and 345, respectively. Such fields may or may not have been part of the database schema, but may also be coded into the software program code 150.

The following discussion describes the methods performed by the inventive system. To provide context, the operation of an exemplary, preferred embodiment of the software program code 150 is described in conjunction with FIGS. 4 and 5.

Figure 4:
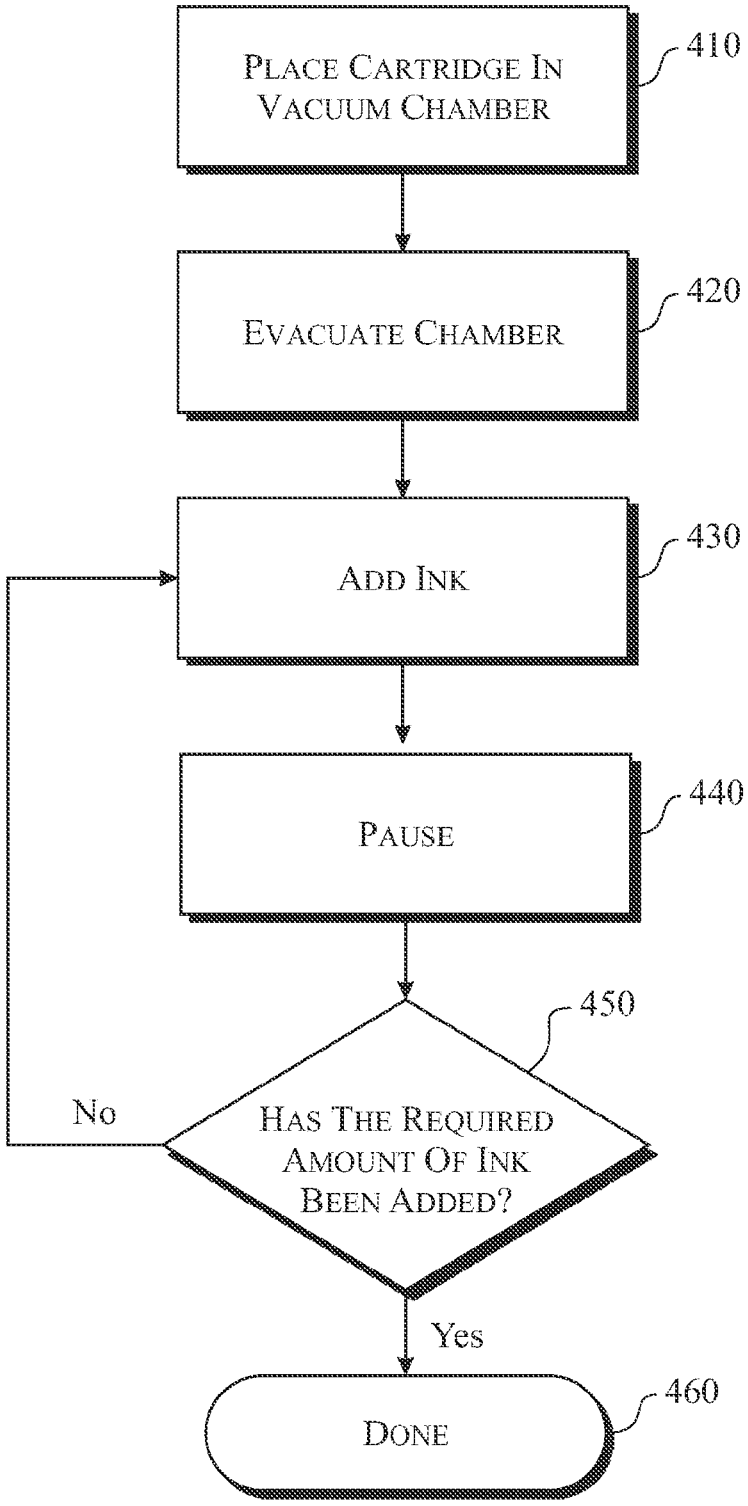
FIG. 4 presents an exemplary flow chart illustrating a series of acts for refilling a printer cartridge.
Figure 5:
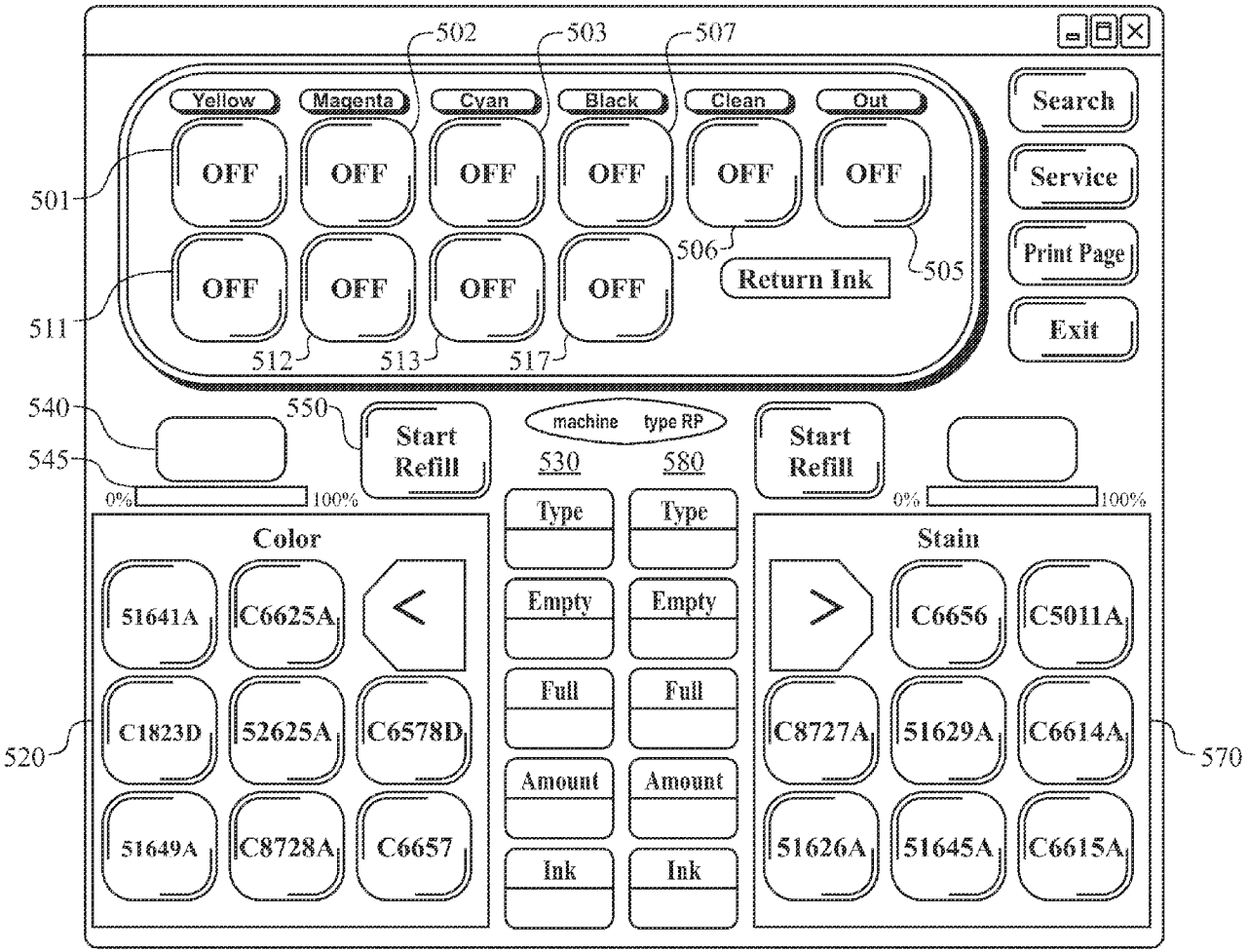
FIG. 5 presents an exemplary diagram illustrating a control screen for the refilling system.

A flow chart illustrating a series of acts for refilling a printer cartridge using system 100 is presented in FIG. 4. As illustrated, in step 410, a color cartridge being filled is placed into the vacuum chamber 170. The user will provide an indication to the system 100 that a particular cartridge is being refilled. This identification is described below in connection with FIG. 5.

Before the cartridge is filled, the user must determine whether the cartridge is empty. The preferred way to make this determination is to weigh the cartridge. If the cartridge weighs more than two (2) grams above an empty weight, then the cartridge most likely contains residual ink, which should be removed. Preferably, the user can pump the residual ink out of the cartridge. If the ink cannot be removed in this fashion, then the cartridge is preferably placed in a centrifuge to remove the residual ink. In addition, dried ink may not be removed, so a cleaning solved may be necessary, which can be pumped into the cartridge, and then removed. Alternatively, the user may clean the cartridge in an ultrasonic cleaner. Additionally, the print head of the cartridge may be reconditioned by steam cleaning.

In step 420, the user places the clean, empty cartridge into the vacuum chamber 170 and inserts the filling needles into the cartridge. The user manually activates the vacuum pump 180, which will reduce the pressure in the chamber down to the setting provided on the vacuumstat 185. Preferably, the vacuumstat 185 is set to control pressure in the vacuum chamber 170 to between 0.4 to 0.9 millibars below atmospheric. More preferably, the vacuumstat 185 is set to control and maintain pressure in the vacuum chamber 170 to about 0.7 millibars below atmospheric.

In step 430, the user initiates the automatic refilling process. Preferably, software program code 150 causes computer 120 to communicate with relay board 140 to run ink filling pump 101-103 to add ink to the cartridge. The ink is added in discrete filling steps. Computer 120 preferably runs pump 101-103 for a brief period of time, defined either in software program code 150, or as specified in database 300.

In step 440, the computer 120 pauses the running pump 101-103 so that the ink will permeate the foam sponge within the cartridge. As the ink displaces air in the foam, the vacuum pump 180 removes the air. In a preferred embodiment, the amount of time that the pumps are paused is longer than the amount of time that they are run, so that the air can be more effectively removed.

In step 450, the computer 120 determines whether the required amount of ink has been added to the cartridge. Because the ink pump is preferably a positive displacement pump, the volume of ink added is directly proportional to the amount of time that the pump 101, 102, 103 is run. The computer 120 calculates whether the required amount of ink has been added, and if not, the computer 120 repeats steps 430 and 440. The number of times that the computer 120 must repeat these steps is preferably based on the required amount of ink to add to the cartridge divided by the amount of ink added during step 430.

In step 460, the computer 120 has added the required amount of ink to the cartridge, and indicates that the automatic refilling process is complete.

The user can then release the vacuum in the chamber 170 by running the vacuum pump 180 in the reverse direction, open the door to the vacuum chamber 170 and remove the cartridge.

The user also has the ability to operate other pumps from the touch screen 130. A diagram illustrating a control screen 500 for the refilling system is presented in FIG. 5. As illustrated, several screen-based buttons are provided so that the user may manually control each pump in the system 100, and may also initiate a refilling process. When activated, the buttons 501, 502, 503 cause the computer 120 to run the yellow, cyan and magenta pumps 101, 102, 103, respectively, in the fill direction. The buttons 505, 506, 507 run the waste, cleaning solution and black ink pumps 105, 106, 107, respectively, in the supply direction. The buttons 511, 512, 513 and 517 run yellow, cyan, magenta and black ink pumps 101, 102, 103, and 107, respectively in the return direction, so that their respective lines can be drained of ink.

The button group 520 permits the user to select a particular type of color ink cartridge that will be refilled. The column 530 provides indicators for the selected cartridge, such as the cartridge type, weight when empty, weight when full, amount of ink required to fill it, and the type of ink. Likewise, the button group 570 identifies numerous types of black ink cartridges that may be selected for refilling. The selected cartridge information similarly appears in column 580.

The button 550 initiates the automatic refilling process described above in connection with FIG. 4. When the user activates this button, the indicators 540, 545 report the progress of the refilling process. Indicator 540 reports the amount of ink that has been added to the cartridge. Indicator 545 reports the percentage filled. Similar indicators are provided for refilling black ink cartridges.

Figure 6:
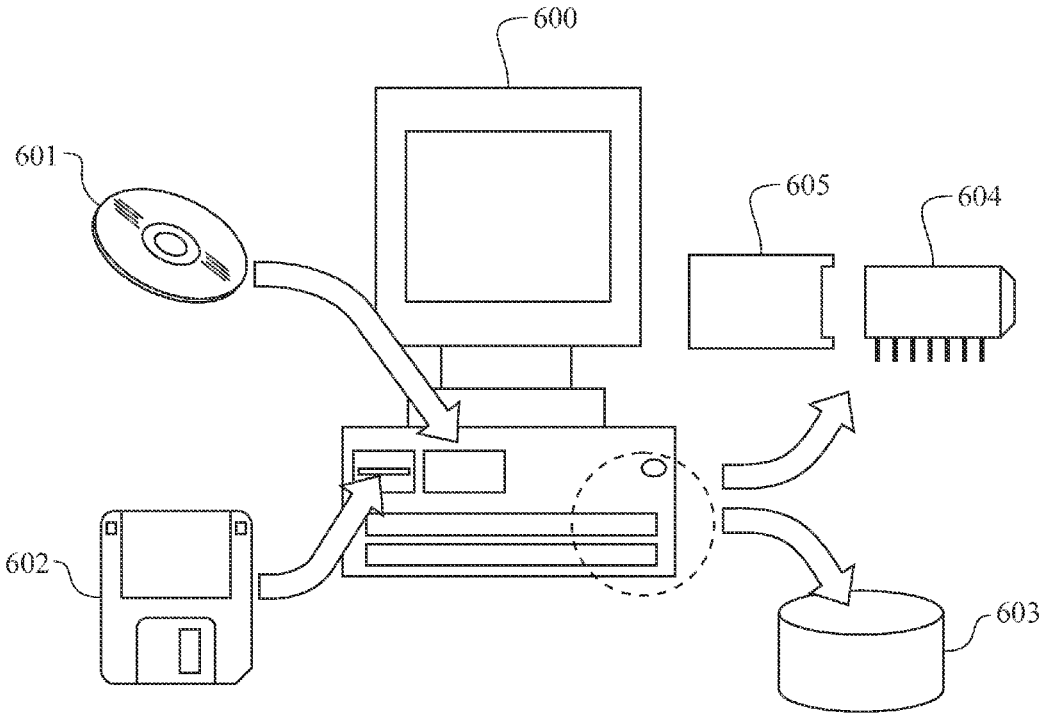
FIG. 6 presents examples of recording media.

In the specification, the term "media" means any medium that can record data therein. Examples of recording media are illustrated in FIG. 6.

The term "media" includes, for instance, a disk shaped media form 601 such as a CD-ROM (compact disc-read only memory), a magneto optical disc or MO, a digital video disc-read only memory or DVD-ROM, a digital video disc random access memory or DVD-RAM, a floppy disc 602, a memory chip 604 such as random access memory or RAM, read only memory or ROM, erasable programmable read only memory or E-PROM, electrical erasable programmable read only memory or EE-PROM, a rewriteable card-type read only memory 605 such as a smart card, a magnetic tape, a hard disc 603, a USB memory stick (not shown, but well understood by those skilled in the art) and any other suitable means for storing a program therein.

A recording media storing a program for accomplishing the above mentioned apparatus maybe accomplished by programming functions of the above-mentioned apparatuses with a programming language readable by a the computer 600 or processor, and recording the program on a media such as mentioned above.

A server equipped with a hard disk drive may be employed as a recording media. It is also possible to accomplish the present invention by storing the above mentioned computer program on such a hard disk in a server and reading the computer program by other computers through a network.

It is understood that any suitable device for performing computations in accordance with a computer program may be used for the computer processing device 600. Examples of such devices include a personal computer, a laptop computer, a microprocessor, a programmable logic device, a computing tablet, or an application specific integrated circuit.

In accordance with the foregoing description, the present invention provides the following advantages:

Because the ink filling process is completely automated, the reliability of the refilled cartridge is greatly improved.

By using a positive displacement pump, the computer 120 can precisely control the amount of ink that is added to the cartridge to prevent problems caused by overfilling the cartridge.

By filling the cartridge while it is under a vacuum, air binding problems are eliminated.

Figure 7:
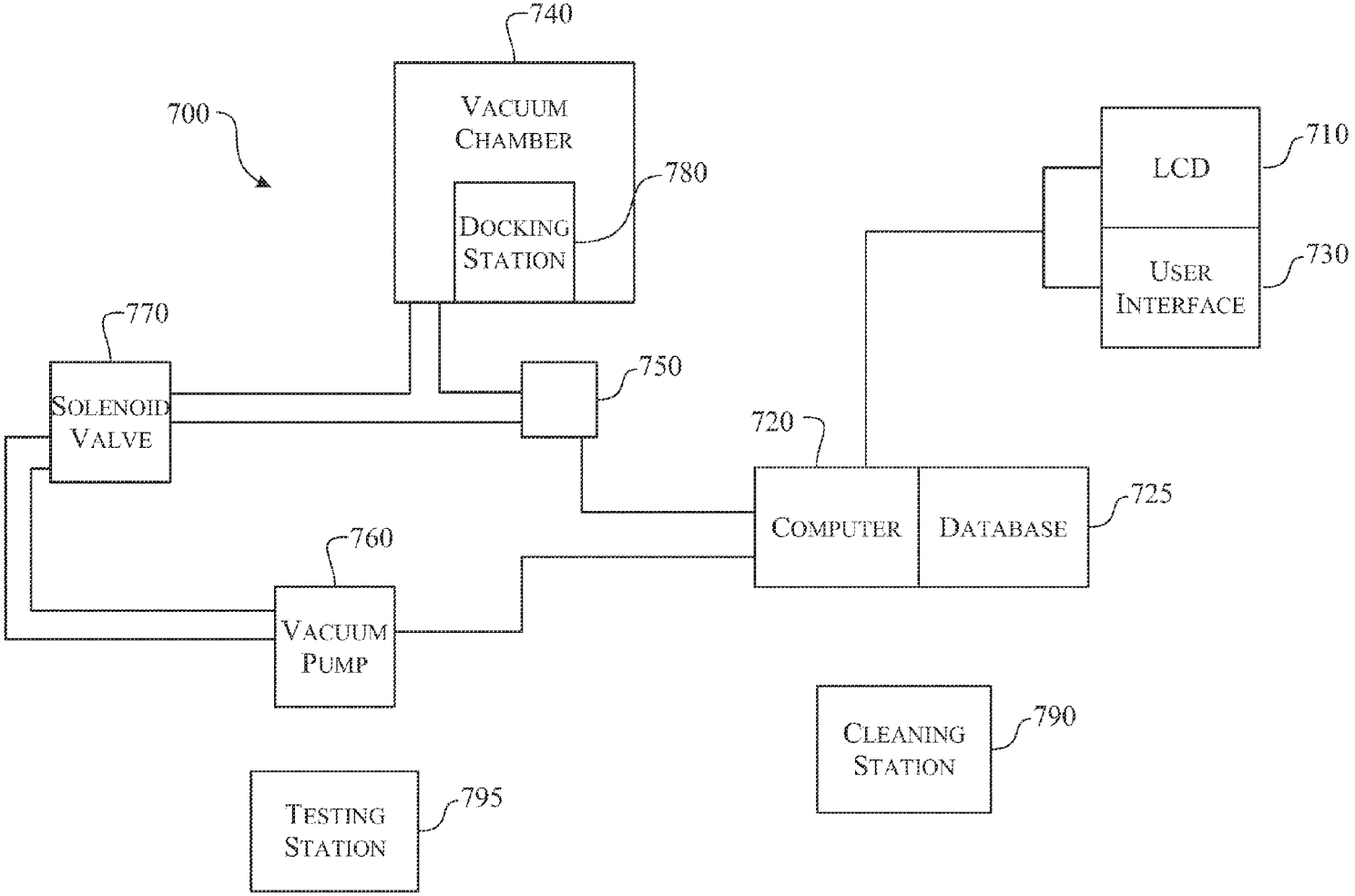
FIG. 7 presents an exemplary block diagram of an automated ink cartridge refilling system in accordance with another exemplary embodiment of the present invention.

A representative block diagram of an automated ink cartridge refilling system 700 in accordance with another exemplary embodiment of the present invention is presented in FIG. 7. It is noted that some of the elements of the automated ink cartridge refilling system 700 functions similarly to those employed by the system described above with respect to FIGS. 1 through 6. For example, automated ink cartridge refilling system 700 comprises a user interface 730 provided to receive user input to control the refilling process. The user interface 730 may be a graphical user interface (GUI), a keyboard, a touch screen, a mouse, a trackball, a touchpad, or any other similar device. Moreover, an LCD display 710 is provided to display or visually present necessary information to the user. Of course it should be understood to those skilled in the art that the user interface 730 and the LCD display 710 may be a single component such as a touch screen activated GUI. Furthermore, both the user interface 730 and the LCD display 710 are provided in signal communication with the computer 720, which comprises a database 725 and software program code.

As previously discussed with respect to FIG. 3 and the database 300, the database 725 maintains a plurality of records associated with a type of printer and the print cartridge used in that printer. Moreover, a user is able to input cartridge identifying information to facilitate the refill process using computer ink cartridge refilling system. In a further embodiment of the present invention, the cartridge identifying information can be the model number of the ink cartridge to be refilled.

In addition, the automated ink cartridge refilling system 700 comprises a vacuum chamber 740, a digital pressure gauge 750 and a vacuum pump 760. The vacuum chamber 740 employs a door that can be opened to place an ink cartridge within the chamber. Air from the vacuum chamber 740 is removed by the vacuum pump 760. Moreover, the digital pressure gauge 750 can read the pressure within vacuum chamber 740 and relay this information to computer 720. It is further noted that in alternative embodiments, multiple vacuum chambers may be employed by automated ink cartridge refilling system 700.

In operation, once a user inputs the model number of the ink cartridge that is to be refilled on the user interface 730, the computer 720 looks up the model number in the database 725 to determine the associated ideal pressure for the specific ink cartridge to be refilled. Accordingly, once the cartridge is placed in the vacuum chamber 740 and its door is closed, effectively sealing the chamber, the computer 720 sends an activating signal to the vacuum pump 760 to begin reducing the pressure in the vacuum chamber 740. The digital pressure gauge 750 may further ascertain a digital measurement of the pressure in the vacuum chamber 740 and relay this information to the computer 720. As a result, the automated ink cartridge refilling system 700 is able to maintain a precise pressure within the vacuum chamber 740 as prescribed by the database 725. Furthermore, once the refill process begins and ink is added to the cartridge, the pressure in the vacuum chamber 740 changes. As this ink is added, the computer 720 is able to recalibrate the pressure in the vacuum chamber 740 based on the read out from the digital pressure gauge 750.

Finally, it should be understood that a valve or the like may be necessary to maintain the pressure in the vacuum chamber 740. In the exemplary embodiment, a solenoid valve 770 is positioned between the vacuum pump 760 and the vacuum chamber 740. The computer 720 may be coupled to the solenoid valve 770 in order to control whether the valve 770 is positioned in an open state or in a closed state. For example, the computer 720 will control the solenoid valve 770 to be open while the vacuum pump 760 is operating such that the pressure can be reduced accordingly.

In yet another embodiment of the invention, the vacuum chamber 740 comprises a docking station 780, which is configured to receive a cartridge cradle (not shown) to facilitate the refill process. In particular, the automated ink cartridge refilling system 700 may be accompanied by a plurality of cartridge cradles provided to hold different models of ink cartridges. As will be described below with respect to FIGS. 8*a* and 8*b*, each cartridge cradle is provided to facilitate the refill of one or more cartridges. Accordingly, when a user inputs the model number of the ink cartridge to be refilled, via the user interface 730, the LCD display 710 will indicate to the user the particular cradle that should be used for that ink cartridge. This information can be stored in the database 725. Moreover, each of the plurality of cradles can be labeled with a particular identification, such as a number, to facilitate the process. Once the ink cartridge is secured in the cartridge cradle 800, the cartridge cradle 800 can in turn be secured in the docking station 780 within the vacuum chamber 740. It is noted that while the specific structural features of the docking station 780 are not shown, the docking station 780 is designed to receive the cartridge cradle, such as that illustrated in FIG. 8*b*.

As an additional feature, automated ink cartridge refilling system 700 further comprises a cleaning station 790, which is provided to clean the ink cartridge print head before and/or after it has been refilled. Specifically, the user may clean the cartridge in a heated ultrasonic cleaner operating at a frequency of 28 kilohertz or less. In one embodiment, the ultrasonic cleaner may be heated to between 60° and 80° Celsius. Moreover, one or more testing stations 795 may be provided to electronically test the ink cartridge before the refill process to ensure the ink cartridge is functional. The testing station 795 enables the user to verify the operability of the ink cartridge before ink is added during the refill process, saving time and money if the ink cartridge is in fact inoperable. It is noted that when multiple testing stations are provided, the database 725 may maintain information defining which testing station should be used based on the particular model number of the ink cartridge.

Figure 8A:
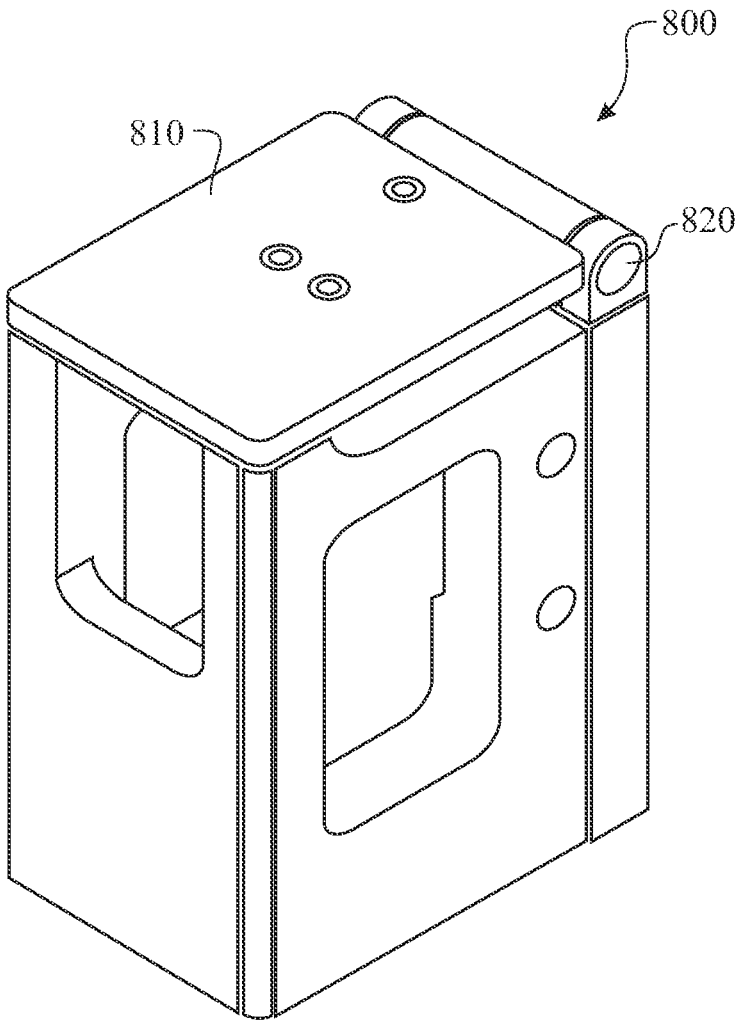
FIG. 8*a* presents an exemplary cartridge cradle in accordance with an exemplary embodiment of the present invention.

An exemplary cartridge cradle is illustrated in FIG. 8*a*. As noted above, the cartridge cradle 800 is provided to securely hold the ink cartridge during the refill process. As shown, the cartridge cradle 800 comprises a lid 810 that can be opened to insert an ink cartridge. The lid 810 may be coupled to the cartridge cradle 800 employing a hinge 820 or any other suitable connecting device. Furthermore, the cartridge cradle 800 comprises internal clips (not shown) that are configured to secure the ink cartridge. It should be understood that different cartridge cradles of the plurality as discussed above might comprise differently shaped clips to secure the different type of ink cartridges that may be refilled. Accordingly, the design of the clips will be based on the shape of the respective ink cartridge.

In addition, the cartridge cradle 800 comprises an aperture (not shown) at its lower panel (opposite lid 810), which is positioned to align adjacent to the ink cartridge print head. As will be discussed in more detailed below, this aperture is provided as part of a suction process to remove old ink from the ink cartridge before fresh ink is added during the refill process.

Figure 8B:
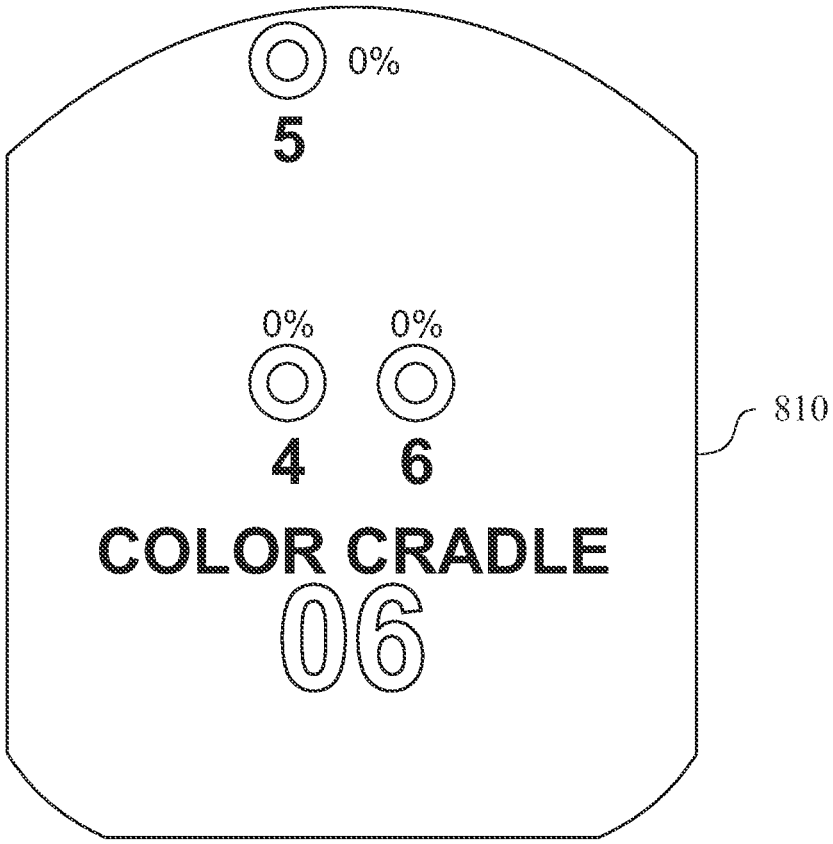
FIG. 8*b* presents an exemplary lid of cartridge cradle in accordance with an exemplary embodiment of the present invention.

An exemplary embodiment of lid 810 is illustrated in FIG. 8*b*. As shown, lid 810 includes identifying information, such as the number "06". As noted above, once the user inputs a model number, the LCD display 710 will indicate to the user which ink cradle must be used to refill that particular cartridge.

Moreover, the lid 810 comprises three apertures 830*a*, 830*b*, and 830*c*. As discussed above, needles associated with color ink pumps 101, 102, 103 may be inserted into the cartridge to enable the refill process. In this embodiment, apertures 830*a*, 830*b*, and 830*c* are configured to guide the insertion of the respective needles into the ink cartridge, and more specifically, into the foam bodies of the ink cartridge, which are provided to retain the particular type of ink: (e.g., cyan, magenta, yellow, etc.). It should be further understood that the position of apertures 830*a*, 830*b*, and 830*c* vary based on the different cartridge cradles employed to refill the different types of ink cartridges.

For example, as shown in FIG. 8*b*, apertures 830*a*, 830*b*, and 830*c* are identified by numbers "4", "5", and "6" respectively. These numbers correspond to the respective needles that should be used to refill the foam bodies of the given cartridge. In another embodiment, apertures 830*a*, 830*b*, and 830*c* may also be designated by colors that correspond to the actual ink color that is to be added by the respective needles. For example, if the aperture 830*a* corresponds to yellow ink, the aperture 830*a* will have a yellow ring around it, indicating that the needle providing the yellow ink should be inserted accordingly. Providing these designations simplifies the process for the user to insert needles into the ink cartridge.

The cartridge cradle 800 and the lid 810 are also arranged such that the lid 810 maintains a predefined distance from the ink cartridge once it is secured. To achieve the best results during the ink cartridge refilling process, ink should preferably be added close to the bottom of the foam body, i.e., close to the ink cartridge print head. As ink is added, it slowly permeates upwards through the foam body. Accordingly, if the needle is not inserted far enough into the foam body, ink will not permeate evenly throughout the foam body. Moreover, it is important not to puncture the screen at the bottom of the foam body that is connected to the ink cartridge print head. Damaging the screen would inhibit the performance of the ink cartridge. By employing the lid 810 and designing the length of the needles such that they can only be inserted a certain distance into the ink cartridge, via the apertures 830*a*, 830*b*, and 830*c*; the ink is dispersed close to the bottom of the foam body. In one further embodiment, the opening(s) of the needles may be at the side of the needle rather than at its tip, which facilitates ink dispersion in a horizontal direction rather than a downward direction. Such design helps avoid ink overflow at the ink cartridge print head.

Finally, it is noted that some ink cartridges do not have predefined holes for the insertion of needles to add ink as part of a refill process. As such, the cartridge cradle 800 stabilizes the ink cartridge and the apertures 830*a*, 830*b*, and 830*c* can further provide a guide for a hand drill to drill holes into the ink cartridge before refill (if necessary). Again, the hand drill can be designed to a certain length such that it does not damage the screen at the bottom of the foam bodies in the ink cartridge.

As discussed above, the cartridge cradle 800 comprises an emptying aperture (not shown) at its lower panel (opposite of the lid 810), which facilitates the removal of old ink from the ink cartridge before fresh ink is added during the refill process. This emptying aperture is aligned adjacent to the ink cartridge print head. In addition, the docking station 780 may comprise a similarly situated aperture that is aligned next to the aperture of the cartridge cradle 800. These emptying apertures enable an ink cartridge emptying system to draw suction from the ink cartridge print head to remove the old ink accordingly.

Figure 9:
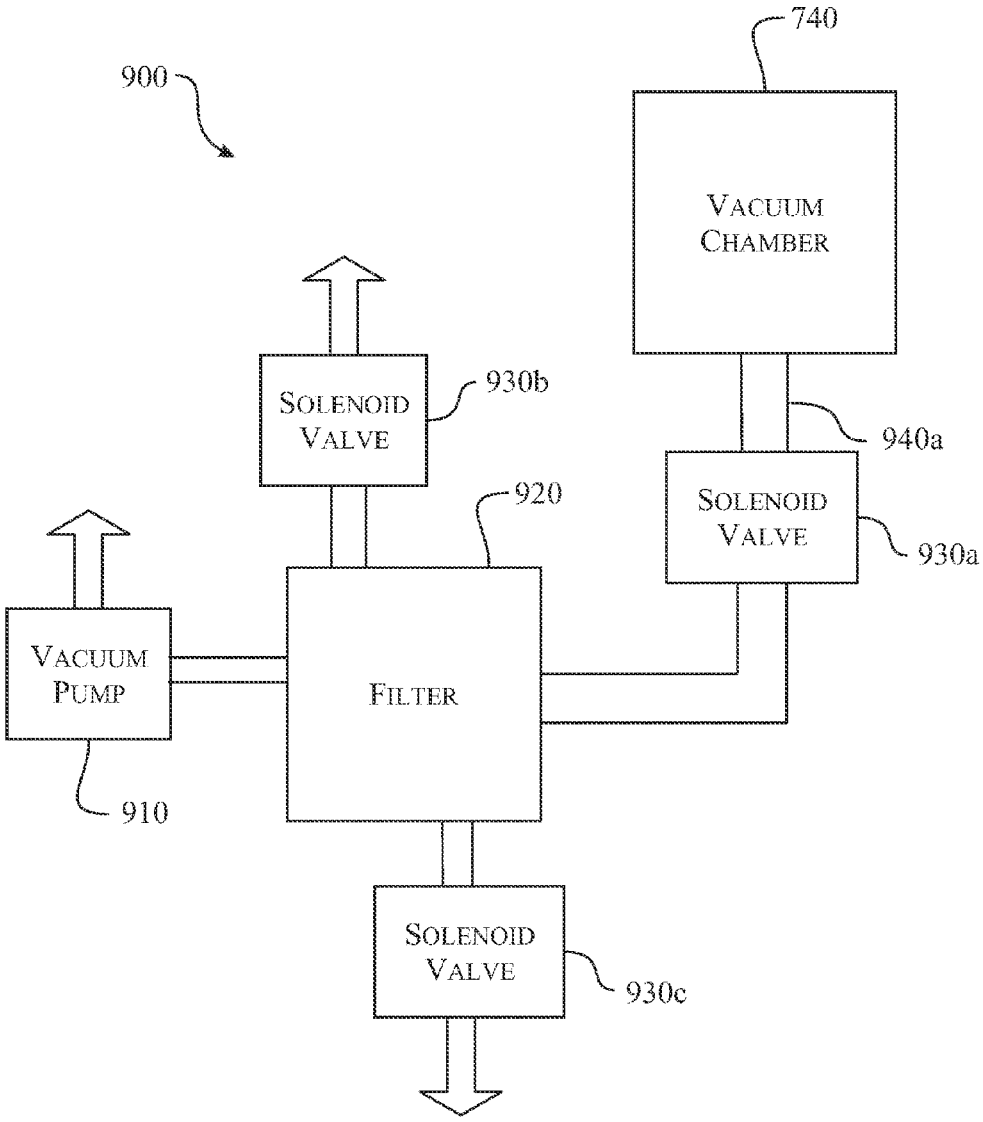
FIG. 9 presents an exemplary block diagram of an ink cartridge emptying system.

An exemplary block diagram of an ink cartridge emptying system 900 is presented in FIG. 9. It should be understood that the ink cartridge emptying system 900 is employed in conjunction with the automated ink cartridge refilling system 700 illustrate in FIG. 7. Once the ink cartridge emptying system 900 has removed all of the old ink from the ink cartridge, the automated ink cartridge refilling system 700 can subsequently refill the ink cartridge with fresh ink as discussed above.

As shown, the ink cartridge emptying system 900 comprises a vacuum pump 910, a filter 920 and solenoid valves 930*a*, 930*b*, and 930*c*. The vacuum pump 910 is coupled to the filter 920 and has an input to draw suction from the filter 920. Additionally, the vacuum pump 910 outputs air flow to the atmosphere. Such components are well known to those skilled in the art. In the preferred embodiment, the vacuum pump 910 is a compressor, such as an axial-flow compressor, a centrifugal compressor, or the like.

Furthermore, the filter 920 comprises an output, which serves as the input to the vacuum pump 910 as well as an input that is coupled to the vacuum chamber 740 via tubing. The solenoid valve 930*a* may be positioned between the vacuum chamber 740 and the filter 920 as shown. Moreover, the tubing 940 above the solenoid valve 930*a* is connected to the aperture of the docking station 780 as discussed above.

In addition, the top and bottom sections of the filter 920 each have an opening to the atmosphere. Both opening are controlled by solenoid valves 930*b* and 930*c*, respectively. Although not shown, the vacuum pump 910 and all three solenoid valves 930*a*, 930*b*, and 930*c* can be controlled by the computer 720.

In operation, once a user has secured the ink cartridge in cartridge cradle 800 and has then secured cartridge cradle 800 in the docking station 780, the ink cartridge emptying system 900 can initiate the ink emptying process via an emptying aperture. Specifically, the computer 720 transmits electronic signals to the solenoid valves 930*a*, 930*b*, and 930*c* to open the solenoid valve 930*a* and close solenoid valves 930*b* and 930*c*. Subsequently, the computer 720 causes the vacuum pump 910 to draw suction from the filter 920, which in turn draws suction from the emptying aperture of the docking station 780. As a result of the suction, old ink is withdrawn from the ink cartridge and drains into the filter 920. The computer 720 causes the vacuum pump to operate for a predefined amount of time. In the preferred embodiment, this process continues for approximately two (2) minutes. However, any time may be used that sufficiently ensures that all of the old ink is removed from the ink cartridge. Once complete, the computer 720 sends an electronic signal to the solenoid valve 930*a* to switch to a closed state. At that point, the ink refilling process to add fresh ink can begin as discussed above. Moreover, the computer 720 can send electronic signals to solenoid valves 930*b* and 930*c* to switch to an open state to drain the filter 920 accordingly.

It is further noted, that while the above-described ink cartridge emptying system 900 is only illustrated as being coupled to one vacuum chamber, i.e., the vacuum chamber 740, in alternative embodiments, the ink cartridge emptying system 900 may be provided to empty ink cartridges positioned in multiple vacuum chambers. Furthermore, the ink cartridge emptying system 900 may be employed to empty additional filling stations that will now be described.

Specifically, in addition to vacuum chambers, the automated ink cartridge refilling system 700 may further comprise ink filling stations configured to refill black ink cartridges. It is noted that it is not necessary to refill black ink cartridges in a vacuum chamber due to the viscosity characteristics of the currently available black ink. Of course, the application is in no way intended to be limited to refilling color cartridges in the vacuum chamber 740 as described above. In alternative embodiments, the vacuum chamber 740 is configured to refill ink cartridges containing black ink.

Figure 10A:
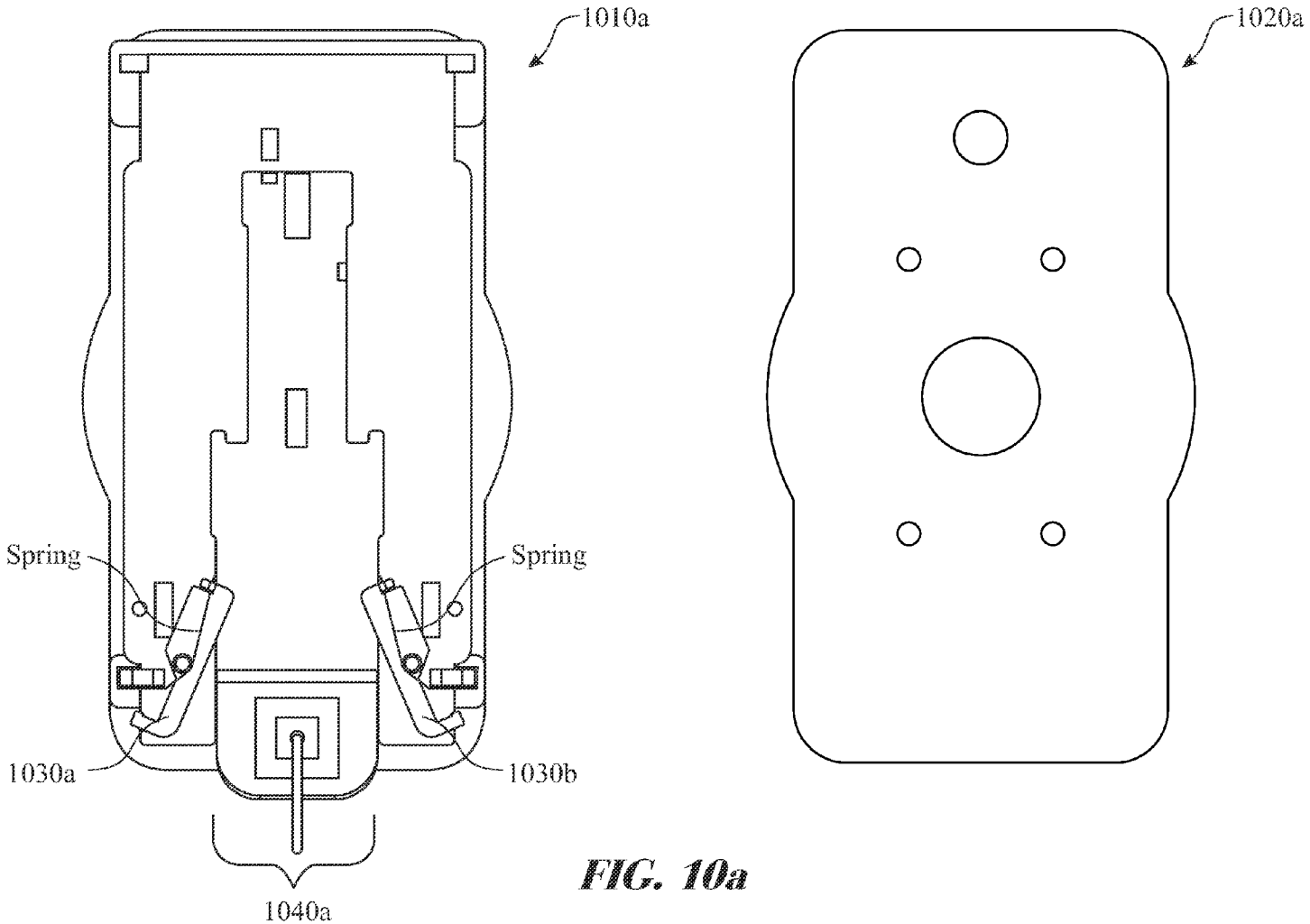
FIG. 10*a* presents an exemplary ink refilling station for refilling a printer ink cartridge.
Figure 10B:
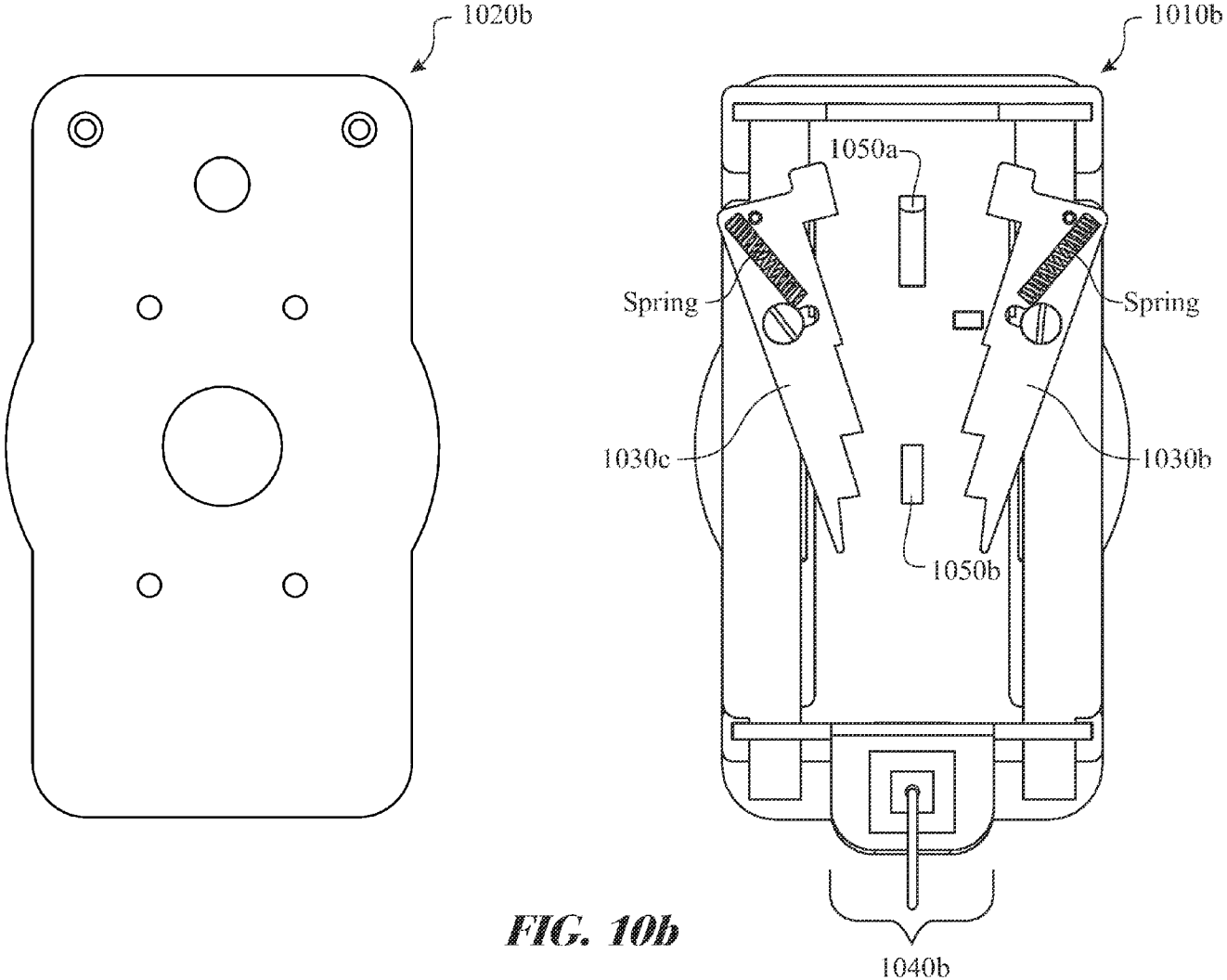
FIG. 10*b* presents an exemplary ink refilling station for refilling a printer ink cartridge.

FIGS. 10*a* and 10*b* illustrate ink refilling stations for refilling a printer ink cartridge in accordance with an exemplary embodiment of the present invention. As illustrated, a ink refilling station comprises an ink refilling clip 1010*a* and a mounting plate 1020*a*. In one embodiment, the mounting plate 1020*a* is mounted to a wall of the automated ink cartridge refilling system 700. Thereafter, the ink refilling clip 1010*a* may be coupled to the mounting plate 1010*a* accordingly. In the preferred embodiment, the ink refilling clip 1010*a* is coupled to the mounting plate 1010*a* using hydraulic pistons (not shown).

In operation, when the ink refilling clip 1010*a* is lifted in a diagonally upward position via the hydraulic pistons, the cartridge clamps 1030*a* and 1030*b* open in a diagonal direction as shown. The cartridge clamps 1030*a* and 1030*b* are coupled to the ink refilling clip 1010*a* using springs as shown. The ink cartridge can then be placed between the cartridge clamps 1030*a* and 1030*b*, which will close and secure the ink cartridge when the ink refilling clip 1010*a* is placed back in its original position. Moreover, the shape of the ink refilling clip 1010*a* may be designed to receive multiple types of ink cartridges having different shapes. As such, the ink refilling clip 1010*a* is configured to receive and refill multiple models of ink cartridges.

As further shown in FIG. 10*a*, the refilling clip 1010*a* comprises a silicon pad 1040*a*. The silicon pad 1040*a* is positioned such that when an ink cartridge is secured by the cartridge clamps 1030*a* and 1030*b*, the print head of the ink cartridge is aligned adjacent to the silicon pad 1040*a*. Using the silicon pad 1040*a*, old ink is removed and new ink is added using a similar operation as described above.

Another exemplary embodiment of an ink refilling station for refilling a printer ink cartridge is illustrated in FIG. 10*b*. The ink refilling station in FIG. 10*b* has substantially the same components as that described above with respect to FIG. 10*a*. In particular, this ink refilling station comprises an ink refilling clip 1010*b*, a mounting plate 1020*b*, cartridge clamps 1030*c* and 1030*d* and a silicon pad 1040*b*. One distinction between the two ink filling stations is the design of the respective cartridge clamps. In particular, different cartridge clamps are provided in each embodiment to receive differently shaped ink cartridges. The refilling clip 1010*b* may further comprise apertures 1050*a* and 1050*b*, which are spaces designed to receive abutments of certain models of ink cartridges. Employing two refilling stations with differently shaped cartridge clamps enables the refilling of a broader range of ink cartridges. It is further noted that when a user inputs a model number into the user interface 730 as discussed above, the LCD 710 will indicate to the user which refilling station should be used. This information can be stored in the database 725.

In a further embodiment, after the ink cartridge in either station is refilled, the refilling clip is rotated to an inverted position. Such inversion is performed when the refilled cartridge employs an ink bag rather than a foam sponge. By inverting the ink cartridge, entrapped air rises to the top of the ink bag, which is adjacent to the print head of the ink cartridge while in the inverted position. This air can then be removed using the suction operation as discussed above. If the ink cartridge were not inverted, then the suction function would merely remove ink.

Figure 11:
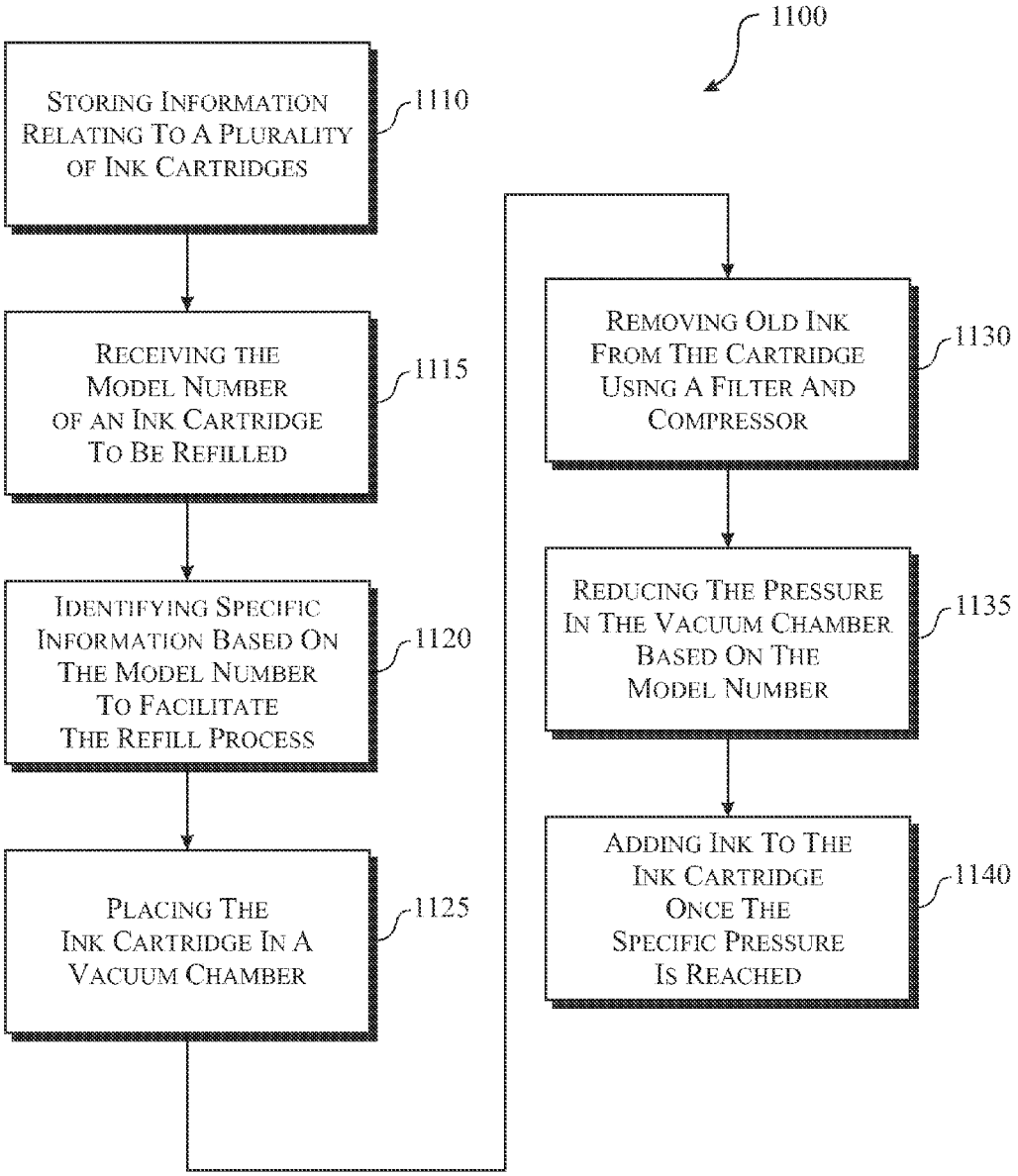
FIG. 11 presents another exemplary method for refilling a printer ink cartridge.

Another exemplary method 1100 for refilling a printer ink cartridge is presented in FIG. 11. It should be understood that the method can be performed employing the automated ink refilling system 700 described above.

Initially, at step 1110, information relating to a plurality of the ink cartridges is stored in a database, such as database 725. Once a user determines the model number of the ink cartridge to be refilled, this information is input at step 1115. Once the model number is received, certain information can be identified from database 725, such as the amount of ink required to refill the ink cartridge, the particular cartridge cradle to be used during the refill process, and the specific pressure for the vacuum chamber based on the model number (step 1120). If the cartridge cradle is employed, apertures in the lid of the cartridge cradle guide the insertion of the needle, which are provided to add ink.

Next, at step 1125, the ink cartridge is placed in a vacuum chamber, such as vacuum chamber 740 described above. In one embodiment, the ink cartridge is secured in cartridge cradle 800, which is in turn placed in docking station 780 of vacuum chamber 740. Once the ink cartridge is placed in the vacuum chamber, old ink is removed from the ink cartridge by a filter and compressor (step 1130).

Once all the old ink is removed, the pressure in the vacuum chamber is reduced at step 1135 to the specific pressure prescribed by the model number. Finally, at step 1140, once the specific pressure in the vacuum chamber is reached, the required amount of ink is added. Additional steps of the method not shown in FIG. 11, but which can be performed at any stage of the refill process include ultrasonically cleaning a print head of the ink cartridge at 28 kilohertz or less and heating the ultrasonic cleanser to a temperature between 60° and 80° Celsius.

Having thus described at least illustrative embodiments of the invention, various modifications and improvements will readily occur to those skilled in the art and are intended to be within the scope of the invention. Accordingly, the foregoing description is by way of example only and is not intended as limiting. The invention is limited only as defined in the following claims and the equivalents thereto.

What is claimed is:

1. A method of refilling a printer ink cartridge, the method comprising steps of:

placing the cartridge in a vacuum chamber;

reducing pressure in the vacuum chamber to a target reduced pressure, the target reduced pressure being below atmospheric, wherein a vacuum is applied to remove entrapped air from the cartridge;

adding an amount of ink during a first time period while the cartridge is under the vacuum;

repeating the adding step until a required amount of ink has been added to the cartridge, wherein a pause between adding steps allows the ink to permeate a foam sponge within the cartridge.

2. A method of refilling a printer ink cartridge as recited in claim 1, wherein the required amount of ink is determined from a cartridge identifying information.

3. A method of refilling a printer ink cartridge as recited in claim 2, wherein the required amount of ink is based on a difference in weight of a new cartridge and an empty cartridge.

4. A method of refilling a printer ink cartridge as recited in claim 2, wherein a number of times the adding step is repeated is based on the amount added during the first time period and the required amount of ink.

5. A method of refilling a printer ink cartridge as recited in claim 1 further comprising a step of pausing for a second time period between adding steps.

6. A method of refilling a printer ink cartridge as recited in claim 1, further comprising a step of removing ink from the cartridge by centrifuge if the cartridge weighs more than about two grams above an empty weight.

7. A method of refilling a printer ink cartridge as recited in claim 1, further comprising a step of ultrasonically cleaning the cartridge.

8. A method of refilling a printer ink cartridge as recited in claim 1, further comprising a step of steam cleaning a print head on the cartridge.

9. A method of refilling a printer ink cartridge, the method comprising steps of:

determining cartridge identifying information respective to the printer ink cartridge subject to being refilled;

determining a target reduced pressure based upon the respective cartridge identifying information;

placing the cartridge in a vacuum chamber;

reducing pressure in the vacuum chamber to the target reduced pressure respective to the cartridge, the target reduced pressure being below atmospheric, wherein a vacuum is applied to remove entrapped air from the cartridge;

adding an amount of ink during a first time period while the cartridge is under the vacuum; and repeating the adding step until a required amount of ink has been added to the cartridge, wherein a pause between adding steps allows the ink to permeate a foam sponge within the cartridge.

10. A method of refilling a printer ink cartridge as recited in claim 9, wherein the required amount of ink is determined from a cartridge identifying information.

11. A method of refilling a printer ink cartridge as recited in claim 9, wherein the required amount of ink is based on a difference in weight of a new cartridge and an empty cartridge.

12. A method of refilling a printer ink cartridge as recited in claim 9, wherein a number of times the adding step is repeated is based on the amount added during the first time period and the required amount of ink.

13. A method of refilling a printer ink cartridge as recited in claim 9, further comprising at least one of the steps of:

a) ultrasonically cleaning the cartridge, and b) steam cleaning a print head on the cartridge.

14. A method of refilling a printer ink cartridge as recited in claim 9, the method further comprising the step of determining a pause time based upon the respective cartridge identifying information.

15. A method of refilling a printer ink cartridge, the method comprising:

determining a required amount of ink for the cartridge; and completing a sequence of ink addition steps, the steps comprising:

a) adding an amount of ink to the ink cartridge during a first time period; and b) repeating the adding step until a required amount of ink has been added to the cartridge, wherein a pause between adding steps allows the ink to permeate a foam sponge within the cartridge.

16. A method of refilling a printer ink cartridge as recited in claim 15 wherein the required amount of ink is based on a difference in weight of a new cartridge and an empty cartridge.

17. A method of refilling a printer ink cartridge as recited in claim 15, the method further comprising a steps of:

determining a cartridge identifying information respective to the printer ink cartridge subject to being refilled; and determining the details for the sequence of ink additions based upon the cartridge identifying information.

18. The method of claim 15, the method further comprising the steps of:

determining a cartridge identifying information respective to the printer ink cartridge subject to being refilled; and determining a pause time based upon the respective cartridge identifying information.

19. The method of claim 15, further comprising at least one of the steps of:

a) ultrasonically cleaning the cartridge, and b) steam cleaning a print head on the cartridge.

20. The method of claim 15, further comprising removing ink from the cartridge by centrifuge if the cartridge weighs more than about two grams above an empty weight.

* * * * *